US005478082A

United States Patent [19]

De Knight et al.

[11] Patent Number: 5,478,082

[45] Date of Patent: Dec. 26, 1995

[54] APPARATUS FOR TEACHING OR CORRECTING THE STANCE OF A GOLFER

[75] Inventors: René E. De Knight, La Massana, Andorra; Major R. Haynes, Seaton, United Kingdom

[73] Assignee: Swingtrue Limited, Gibraltar

[21] Appl. No.: 244,272

[22] PCT Filed: Sep. 24, 1993

[86] PCT No.: PCT/GB93/02004

§ 371 Date: May 23, 1994

§ 102(e) Date: May 23, 1994

[87] PCT Pub. No.: WO94/07576

PCT Pub. Date: Apr. 14, 1994

[30] Foreign Application Priority Data

Sep. 25, 1992 [GB] United Kingdom ..... 9220285
Mar. 5, 1993 [WO] WIPO ..... PCT/GB93/00348

[51] Int. Cl.[6] ..... A63B 69/36

[52] U.S. Cl. ..... 273/187 R; 434/232

[58] Field of Search ..... 273/187 R, 187 A, 273/187.1, 186.1, 186.3; 434/232

[56] References Cited

U.S. PATENT DOCUMENTS

| | | | |
|---|---|---|---|
| 1,409,688 | 3/1922 | Edgar | 273/187 R |
| 2,606,026 | 8/1952 | Young | 273/35 |
| 2,777,697 | 1/1957 | Crossot | 273/187 R |
| 4,023,810 | 5/1977 | Lorang | 273/186 C |
| 4,384,718 | 5/1983 | Cachola | 273/187 R |
| 4,434,983 | 3/1984 | Taggart | 273/187 R |
| 4,915,387 | 4/1990 | Baxstrom | 273/187 A |
| 5,163,686 | 11/1992 | Bergman | 273/187 A |

*Primary Examiner*—William H. Grieb
*Attorney, Agent, or Firm*—Breiner & Breiner

[57] ABSTRACT

A golfer's stance for correctly addressing a golf ball using different clubs is taught by using a mat having a ball line on it with markings showing the different locations at which the ball should be put. The mat has on it either a single detachable strip or different sets of detachable or permanent strips. The or each strip indicates optimum stance lines with which the golfer's feet should be aligned when using a club of weight or number associated with the strip being used at any one time.

14 Claims, 5 Drawing Sheets

APPARATUS FOR TEACHING OR CORRECTING THE STANCE OF A GOLFER

This invention relates to golfing apparatus, and particularly to apparatus for teaching golfers where their feet should be placed when hitting a golf ball in a specified direction with a known club. The apparatus can be used to train tyro golfers, or to help experienced golfers to eliminate a stance or swing defect.

People wishing to learn golf usually take lessons from an experienced golfer and/or use a video to learn the correct grip and stance. The present invention aims at providing a teaching aid to act as a visual guide, intended to be recalled from memory by the golfer when addressing a ball and used mentally to position the feet correctly when wishing to use a selected club.

Various apparatus has been proposed to assist in developing appropriate stance and swing. U.S. Pat. No. 4,384,718 discloses a device consisting of three flat strips variably positionable one with another to secure appropriate positioning of the golfer's feet and the ball. A more popular approach to the problem involves the provision of a mat with markings on it on which the golfer is to stand. U.S. Pat. Nos. 4,915,387, 2,606,026 and 4,023,810, and British Patent Specification 1305710 are representative of this approach. Most involve complex markings for foot position and they do not address the importance of providing a visual guide corresponding to the desired line of flight of the ball when it is struck.

U.S. Pat. No. 4,434,983 discloses a mat having a T-bar guide secured to its surface with the horizontal portion of the T providing a plurality of possible positions in which a tee may be located. The device shown in this specification, however, does not allow for the positioning of the feet of the golfer such that the line joining the fronts of the golfer's feet when positioned on the mat runs at an angle to the intended line of flight of the ball. It is inflexible and visually cluttered.

We have now found that improved mats may be designed which are simple in construction and effective in training by providing a mat having a flight line for the ball marked clearly on it generally near one edge, and provided with one or more means to define a stance line which can be adjusted both with respect to its distance from the flight line and with respect to its angle.

Accordingly the present invention provides apparatus for teaching or correcting the stance of a golfer when addressing a golf ball, including a mat covering an area big enough to accommodate both feet of the golfer when adopting an addressing stance, in which the mat is marked with a ball line of alternative ball positions aligned with the intended line of flight of a golf ball, and in which the line has associated with it indicia indicating the positions along the line at which a golf ball should be placed when it is to be struck with a golf club of specified weight or number, and in which the mat has means defining at least one stance line which is at an adjustable position from the ball line and which subtends an acute angle with the ball line. The apparatus may include a suitable stand for the ball, designed to be placed on the line and to support the ball above the mat at a level corresponding to the optimum level above the ground of a teed-up ball.

Using such a mat, the golf professional can identify for the trainee golfer the appropriate stance line for any particular wood or iron and this can be noted down and used subsequently by the trainee when he or she wishes to practice without the professional. Preferably the ball line has three alternative ball positions designed to correspond with a comfortable position for placing the ball to be struck with woods, long irons and short irons respectively.

According to a particular feature of the present invention, there is provided for use in conjunction with the mat, a flexible upstanding guide, designed to be positioned such that it lies above the surface of the mat and extends from a planar section positioned adjacent to the side of the ball line remote from the user and substantially at the position of the ball on the tee to an arcuate section which extends to cross over the ball line so that its free end lies between the feet of the user and the ball line. The guide thus serves to define an arcuate path which is the optimum path of the head of the club as it approaches the ball.

As the club is swung to hit the ball, if it is swung in the correct arc (so that the ball takes off along the ball line), the guide is untouched and does not move. If, on the other hand, the club is swung such that the ball follows not the intended flight path or line of flight but a path angled towards the golfer, the club will hit the arcuate portion of the guide and give a clear indication to the golfer that the portion of the swing just before the contact of the head of the ball was too far away, so the ball will swing in. Conversely, if the swing is such that the ball travels at an acute angle to the intended flight path but on the far side of the flight path remote from the golfer, the club will hit that part of the guide immediately adjacent the initial portion of the flight path. The guide is preferably made of resilient and impact resistant plastics so that it is not damaged by being hit by a club, but it is extremely easy for the trainee golfer to see whether he is swinging the club in such a way as to make the ball go to the left or the right of the intended line of flight.

This form of guide, which preferably has means enabling it to be secured relative to the ball line, for example by being traversed by a tee which passes through part of the guide and part of the ball line, constitutes a second and separate feature of the invention and can be used independently of the mat described above.

The present invention will now be described by way of example with reference to the accompanying drawings, in which.

Figure 1:
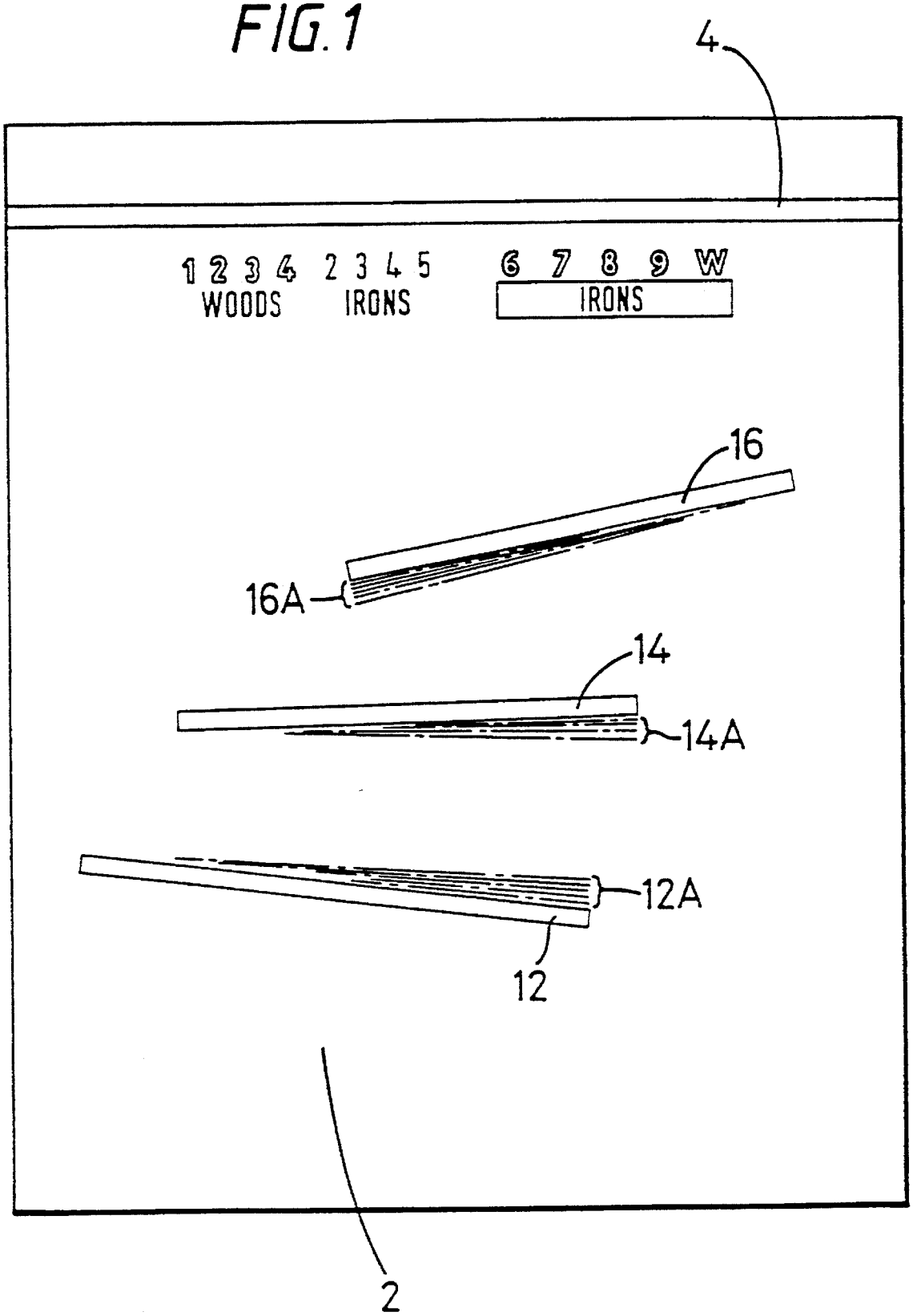
FIG. 1 is a plan view of one mat of the present invention.

In the drawings, corresponding components in all four embodiments are given the same references.

The apparatus shown in the drawings comprises a mat 2 of rubber or other non-slip material which is hard-wearing. The mat has moulded into it, or applied to it, various indicia as described below. The mat is preferably provided on one or both faces with ribs (not shown) extending parallel with the short edges of the mat to enable it to be easily rolled up for storage and laid flat for use. The underside of the mat may have webbing strips attached which can be tied together or otherwise fixed, e.g., with a burr fastener, to hold the mat rolled up. In a particularly preferred case, the strips may incorporate loops enabling the mat to be hung up flat on two speed hooks, if desired.

In other versions of the mat, its main body 2 may be of plastics material with a surface of simulated grass. The club labels and the stance strip(s) symbols could then be printed on plastics labels which could then be welded or otherwise adhered to the simulated grass.

The first indicium is a ball line 4, consisting of a stripe of contrasting colour near one short edge of the mat, to form a 'ball line' intended to be on or parallel to the intended line of flight or flight path of a golf ball positioned on a suitable tee set on the line at the time it is to be struck by a golfer having his or her feet on the body of the mat. In parallel with the ball line 4 is a row of numbers in three groups spaced-apart from each other by non-uniform distances. One group of numbers is intended to show where a golf ball is to be positioned on ball line 4 when the golfer is using any of four woods. The respective numbers are applied to the surface of the mat 2 in a colour which a clear contrast therewith, such as red. Associated with the number is the legend 'woods' of which the letters may also be of the same colour. Obviously, any style of lettering may be used. Of the other two groups, one group is dedicated to the longer irons, and is differentiated visually from the numbers associated with woods, as by the numbers themselves being printed on a background of yellow or contrasting colour, with the legend 'irons' being applied adjacent thereto in any convenient and permanent manner. The position of the ball when being addressed by the shorter irons is indicated by the remaining group of numbers, which are shown in yet another contrasting colour, such as beige, with the associated legend 'irons' being printed in black on a rectangular background also of beige. The letter 'W' is included with the shorter irons, as corresponding to where the ball is to be positioned on line 4 when intended to be hit with a wedge.

Permanently positioned on mat 2 are three stance strips 12, 14 and 16. A golfer is intended to position the toes of his or her shoes in line with the axis of strip 12, or with one of its associated 'phantom' strips **12*a*. In similar fashion, the golfer is intended to use stance line 14 or its associated phantom lines when using the longer irons, and strip 16 or sub-strips 16*a*** when using the shorter irons. In all cases, the particular line or axis to be used for aligning the tips of the golfers shoes is usually found pragmatically, either by the golfer himself, or when assisted by a professional.

It can be seen from FIG. 1 that the phantom strips in effect delineate a series of lines diverging at successive angles from the axis of the main strip. Although not shown in the drawing, the phantom lines may be provided with a series of references, so that when a golfer is using say a number 2 wood, he knows from his experience that he should position his feet aligned with say, line 12-5, in the case where the phantom lines are numbered from, say, 1 to 6.

Although the distances of the main stance lines 12 to 16 from line 4 are fixed, and correspond to where the feature be positioned of a golfer of average height, taller or shorter golfers may position their shoes so that they are forward of their respective stance line, in the case of shorter golfers, or further away from the respective stance line, in the case of taller golfers. In all cases, the tips of the golfer's shoes should be positioned on a line parallel with the respective stance line and at a distance from that line which has been found by experiment and/or tuition. It has been found that after the apparatus of this invention has been used for teaching or correcting a golfer's stance when using a particular club, when he or she is actually playing golf, and needs to use that club to address a ball, a golfer is able to project a mental image of the ball line and his stance line on to the ground, and to position his body and feet accordingly so as to be able to hit the ball with accustomed ease.

Figure 2:
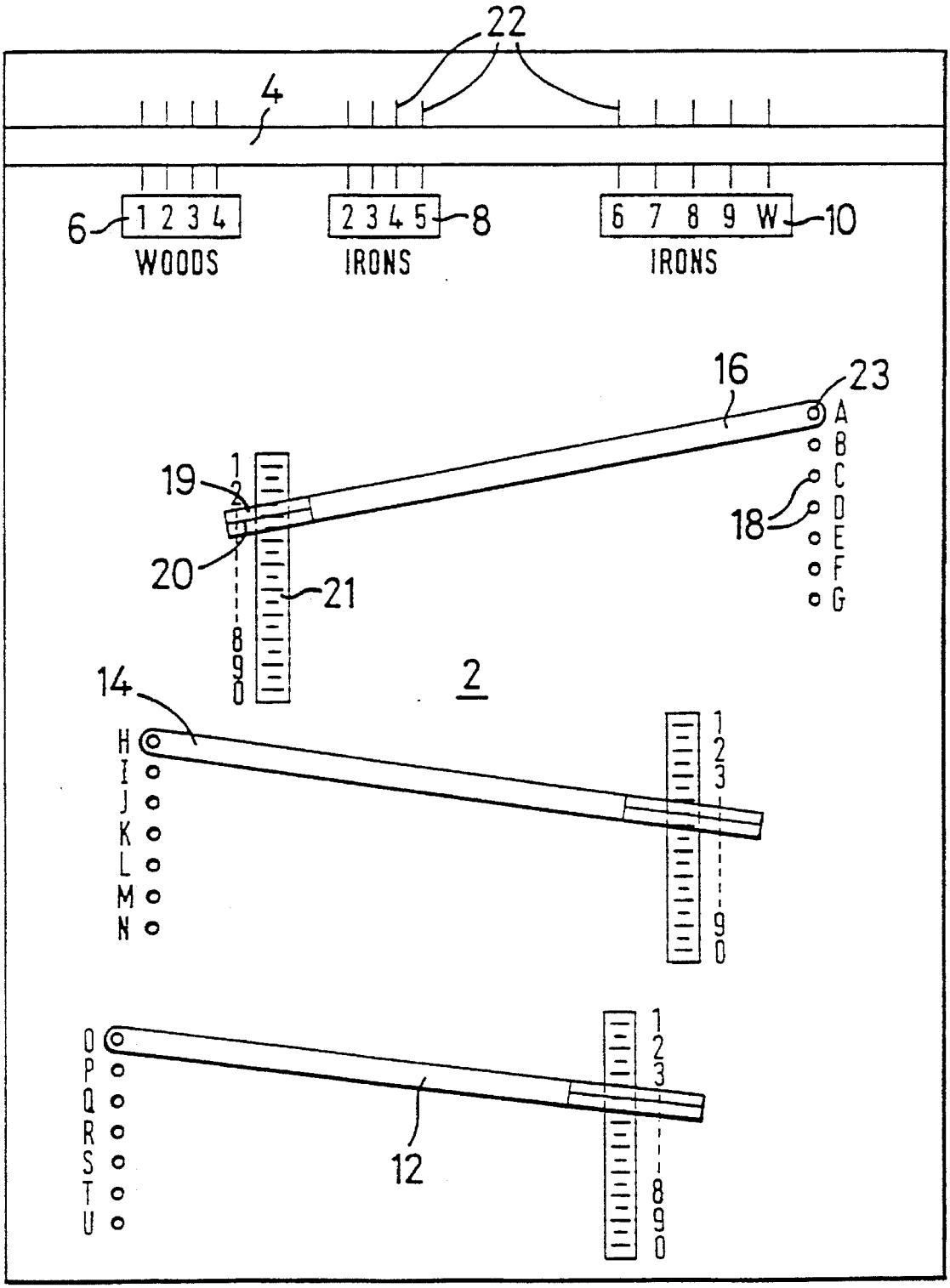
FIG. 2 is a plan view of a second embodiment.

In that embodiment of the invention shown in FIG. 2, the ball line 4 is in the same position on the mat 2 as in FIG. 1. A minor change is that the numbers of the respective sub-groups of clubs are placed on labels 6, 8 and 10 of different colours which contrast with each other and with the green of the main body of the mat. Extending transversely to the ball line 4, on both sides thereof, are perpendicular sight lines 22. Each line is aligned with a respective number on the labels, so as to indicate fairly precisely at what part of ball line 4 a golf ball should be teed-up.

The sight lines 22 are of use in helping the golfer to ensure that the face of his club is always parallel with a sight line 22 when approaching and contacting the ball at the respective point on line 4. It has been found that the golfer is able to detect any divergence between the club face and the respective sight lines as the club comes in focus when approaching the ball. This serves to help the golfer to perfect his or her grip on the club to reduce or remove any tendency to hook or slice.

The main difference over FIG. 1 is that the stance lines 12 to 16 are adjustable. To this end, each stance line is formed from a strip of tough plastics material, such as of polymethylmethacrylate, having its main body coloured white, but having a transparent end portion 19 with a centre line 20 extending along the axis of the strip. At one end of the strip, and projecting from the underface thereof, is a stud 23 which is able to be inserted into any of a line of metal sockets 18 embedded in the material of the mat. The sockets 18 are aligned perpendicularly to line 4, and each has a reference letter positioned alongside it to identify it. As shown, letters are used, but of course numbers or other symbols could be used similarly. Also as shown, the symbols associated with the sockets for use with each of the stance strips are referenced uniquely, but of course the same references can be used in association with each stance strip, as there is unlikely to be confusion about which is the stance strip to be used when the golfer is intending to use any particular club.

Positioned in parallel with the line of sockets 18 is a strip 21 of a colour contrasting with the background colour of the mat. On the strip 21 is a series of marks or references. If marks are used, then alongside the strip is a series of symbols, so that the marks are uniquely identified and enable the line of sockets 18 and the strip 21 to function as a coördinate system by means of which the strip 16 may be reliably repositioned on the mat surface in exactly the same position as it was on a previous occasion when its coördinates were noted. Thus for example, when a golfer had been using a number 6 iron, he or she might have found by experiment or tuition that his shoes should have a common tangent formed by a strip 16 when extending between socket A on the right-hand side of 16 as viewed, and mark 4 on the left-hand as viewed. Thus the player could have noted in a notebook that for him, when using a number 6 iron, stance strip 16 would have the coördinates A4. He could build a look-up table for the positions of all three strips when used with each golf club.

It will be seen that with the stance strips 12 and 14, their respective sockets 18 are on the left-hand side of the mat for a right-handed golfer, and the respective reference strips 21 are on the right-hand side.

The sockets 18 may take the form of hollow rivets extending through the body of the material of the mat 2, in which case the rivets would form a series of sockets on the other face of the mat.

In all mats of the present invention, the markings shown in the Figures is intended to be reproduced on the other face of the mat 2, but orientated to accommodate a left-handed golfer. In such a case, the sockets appearing on the 'wrong' face of the mat can be ignored by the golfer as they will have no references associated with them, thus indicating that they are not to be used, whereas it will be clear to such a golfer which line of sockets and which respective reference line 21 he would be intended to use.

As an alternative to using a stud-and-socket pivotal connection, the weight-bearing surfaces of the mat may be covered with a tough looped-pile fabric, while the under-surface of most of the length of each strip is covered with a fabric presenting resilient hooks, to provide two fabrics able to act as burr-fastening material of the type sold under the trade mark VELCRO. In such a case, the line of sockets 18 would be replaced by a line of reference symbols, similar to line 21 of FIG. 2, to indicate unambiguously with what the respective end of the stance strip should be aligned. After the strip has been so aligned with the reference symbols at both ends thereof, the strip is pressed down on top of the mat, as by the golfer's feet, to cause the hooks to become embedded firmly in the looped-pile fabric, thus holding the stance strip firmly in position against accidental displacement by the golfer's feet when addressing and striking the ball.

In an alternative embodiment, not shown in the drawings, the mat 2 may have permanently secured to it three pairs of parallel strips of looped-pile fabric extending substantially perpendicular to ball line 4. Each stance strip may have two patches of hooked-pile fabric secured to its underside, so that each strip may be secured to its respective pair of looped-pile strips to extend between them at a desired angle to the ball line, and at a chosen distance therefrom.

Alternatively the mat may be divided either physically or notionally into a graticule permitting small areas of its surface to be identified by some coördinate system, such as (x,y) or (r,θ). Each mat may be sold with a look-up table setting out the coordinate positions of where both ends of a strip should be located to mark the toe-line of a golfer of known height and stance, when using a club associated with that strip. The two points or areas indicated by the table are identified or marked, and the marks on the respective strip are aligned with them before the strip is pressed down into position, from which it can be removed by force when it needs to be repositioned for use by a golfer of different height and/or stance.

Whereas the mat may be sold with a look-up table devised by the manufacturer, it is preferred for the golfer to produce his or her own look-up table, based on his club professional's advice and/or his or her own experience.

When using the apparatus of the present invention, the golfer selects a particular club and positions his or her ball on a suitable support stand which is placed on line 4 in line with the symbols corresponding to that club. The golfer then positions on the mat at least that stance strip corresponding to the club intended to be used. The golfer positions the strip with its ends at the two points indicated by his or the manufacturer's look-up table, and then presses the stance strip firmly into place. The golfer then positions his or her feet on the mat at a comfortable distance apart and in the appropriate position relative to the stance strip. If his or her natural stance places his or her feet at a distance apart less than the length of the respective stance strip, then his or her feet are positioned equal distances from both ends of the respective strip.

For a golfer of average build, the tips of his shoes are intended to rest on the perceived median line of the respective stance strip. The golfer then adjusts the position of his grip on the handle of the selected golf club so that, when standing easily in an addressing position, the head of the golf club is just behind the teed-up golf ball. Teeing up may be effected by using a modified tee having a foot backed with a hook-pile fabric to mate with a strip of looped-pile fabric extending along the line 4.

The ball line 4 may also be used to improve putting performance. Placing his ball on the line, the golfer would adjust the position of his feet relatively to the line until the ball travels along the line consistently when struck. Hopefully, when doing so, the golfer's feet are able to be positioned relative to a stance strip so that, although that stance strip is intended to be used with another golf club, its coördinates may make it useful when the golfer is using a putter.

Figure 3:
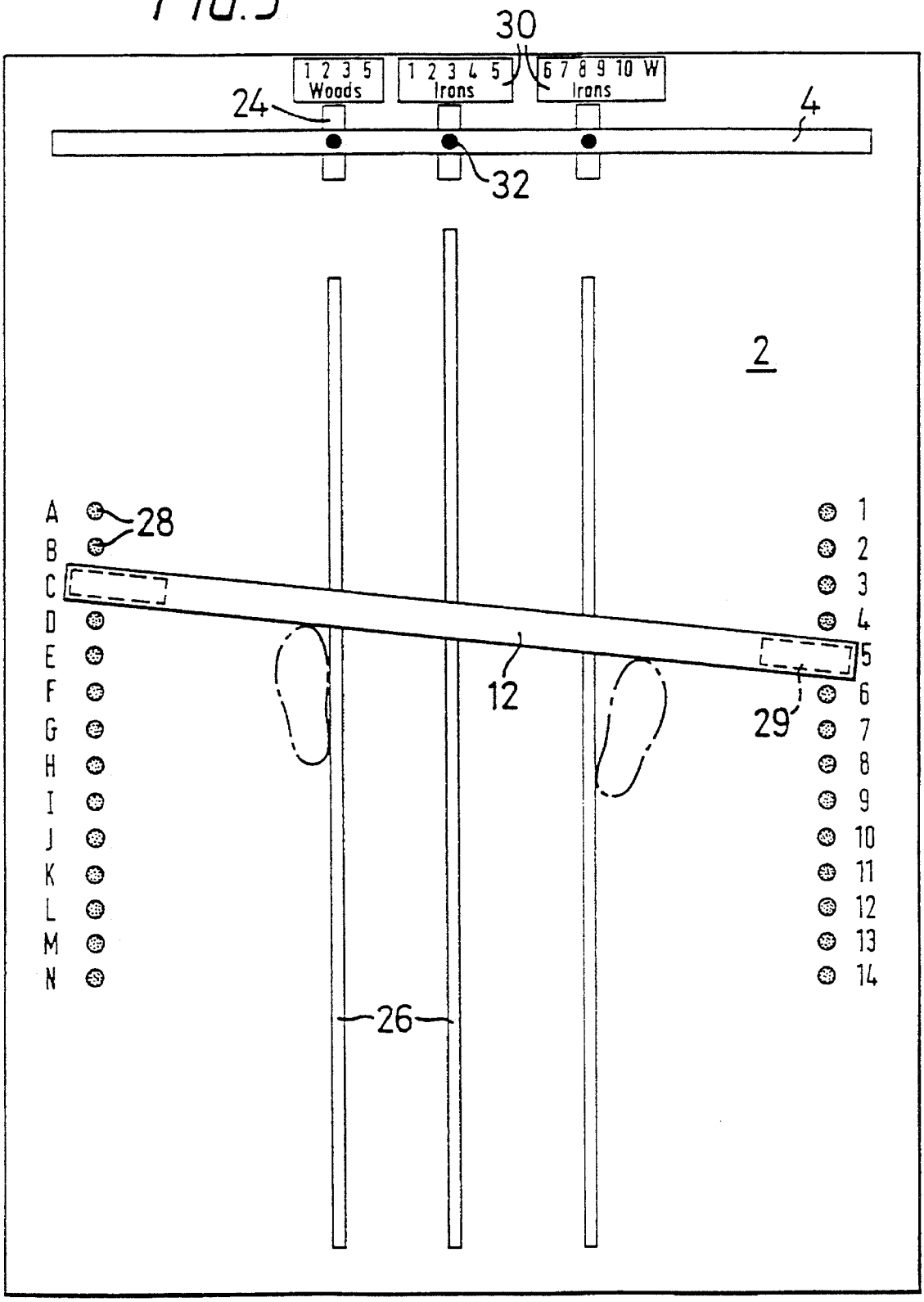
FIG. 3 is a plan view of a third embodiment.

In a form of mat shown in FIG. 3, the ball is intended to be positioned on one of only three positions when using any of the regular clubs. Each of these positions is indicated by a rectangular area 24 extending perpendicularly to line 4. Each area 24 has associated with it a label 30 of beige or other contrasting colour having on it the numbers and types of the clubs which are to be used when a ball is positioned at the intersection of area 24 and ball line 4. Each area 24 may be of the colour associated with the particular sub-group of clubs, as already discussed in connection with the previous embodiments, leaving the line 4 white to make a stronger visual impression on the golfer.

Extending perpendicularly to line 4 from each area 24 is a reference line 26, likewise of a colour which contrasts with the visible surface of mat 2. The lines 26 end short of line 4, so as not to reduce its visual impact, although the centre line is longer to act as a pointer to the central ball spot 32.

The main difference over the previous two embodiments is that there is a single stance strip to be used irrespective of the club. To enable the stance strip to be positioned anywhere over the range of positions possible with the other two embodiments, the surface of the mat is provided with two lines of patches 28 of looped-pile fabric. The under surface of the stance strip 12 has its ends covered with patches 29 of hook-pile fabric. Each line of patches 28 has reference symbols associated with it so that the stance strip 12 may be arranged to be pressed into contact with any patch 28 in each series, so as to ensure that the strip 12 extends at any desired angle to the axis of ball line 4, and at an appropriate distance therefrom. As shown, the strip 12 would have the coördinates C5.

The manner in which the strip 12 is held in position on the mat against accidental displacement does not form part of the subject-matter of this invention. In any embodiment the hollow rivets and studs may be replaced by VELCRO fasteners. The strip 12 may even have a stud at one end and a VELCRO patch at the other, to cooperate with a line of rivets and a line of patches.

It is envisaged that, irrespective of which club a golfer is intending to use, a right-handed golfer will place his left foot with his toe against strip 12 and the inner side of his shoe at a tangent to the left-most reference line 26. His right foot would then be positioned at any other area of the mat surface at which his stance is of the appropriate width for the club being used and with strip 12 being tangential to the toe of his shoe.

It is envisaged that the mats would be sold by or through professional golfers. When such a 'pro' is teaching a tyro by means of the mat, the use of a look-up table could be dispensed with. Instead, the pro could adjust the position of the feet of the tyro on a pragmatic basis for all the clubs that he or she would use. Once the stance strip, or the respective stance strip, had been so adjusted, the coordinates of its ends would be noted in a personal look-up table, to permit the strips to have their positions changed for use with different clubs, and perhaps by different golfers, and later reattached to the mat.

Figure 4:
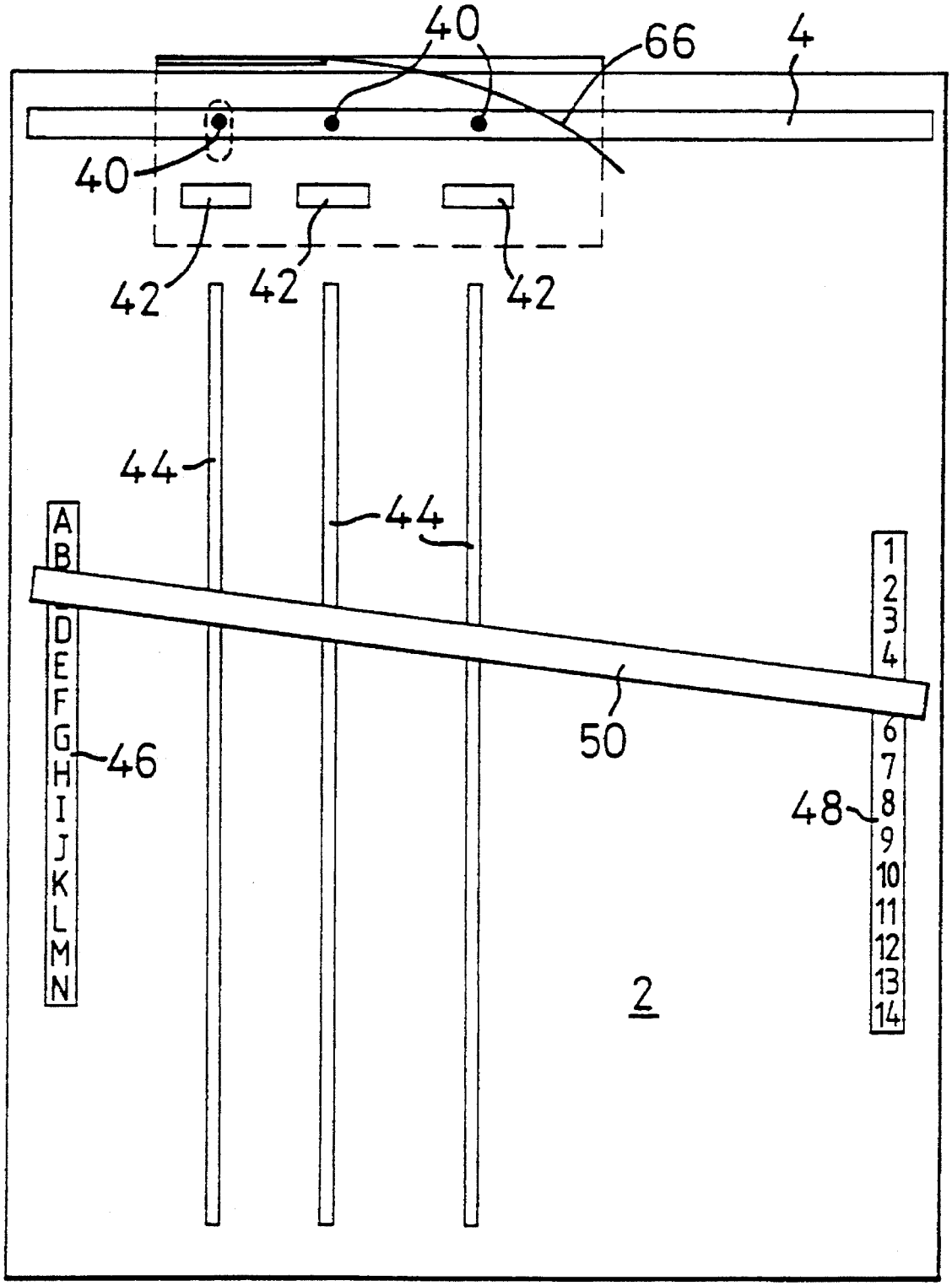
FIG. 4 is a plan view of a fourth embodiment.
Figure 5:
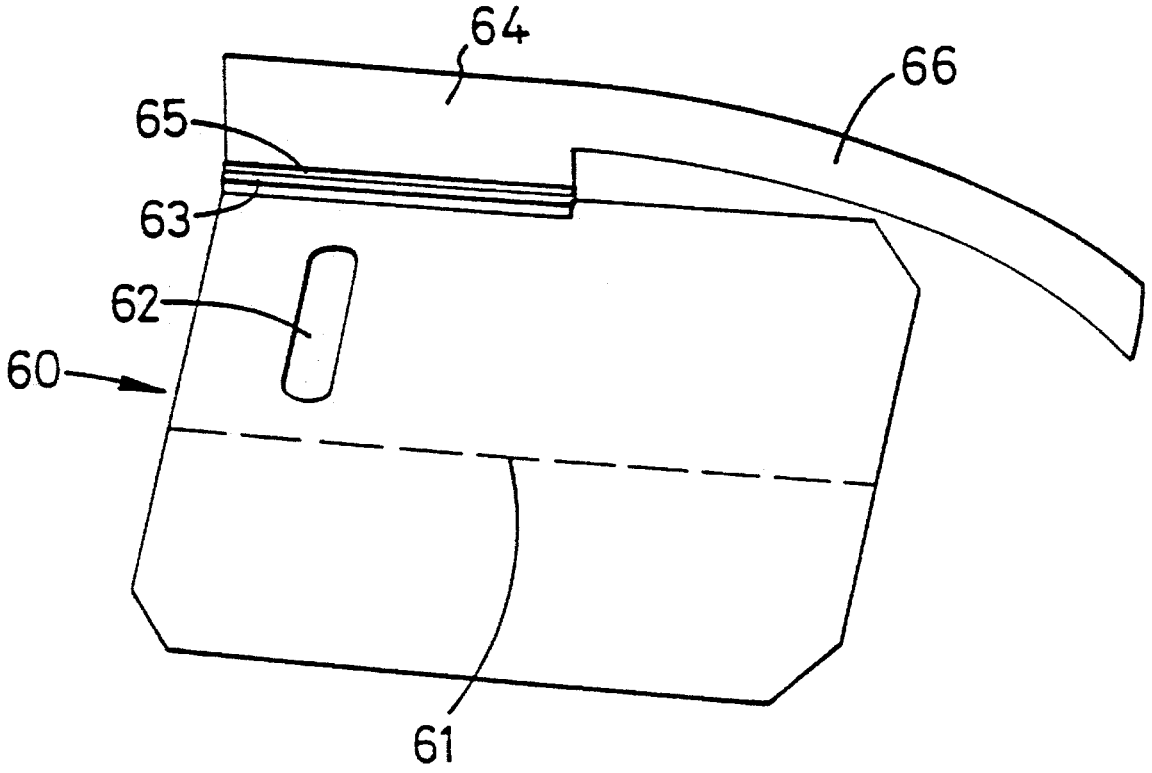
FIG. 5 is a perspective view of the swing guide unit shown in plan in FIG. 4.

Referring now to FIGS. 4 and 5, FIG. 4 shows in plan view a further form of mat in accordance with the invention, The mat consists basically of a rectangular area of plastics simulated turf material (for example that sold under the Registered Trade Mark ASTROTURF). Adjacent the top edge of the mat as shown in the drawing is an inset white strip for defining the desired line of flight line. This is inset from the upper surface of the plastics "grass" on the mat and has three circular apertures 40 which register with apertures in the base of the mat itself.

Likewise, inset in the simulated grass are three short labels 42 which bear printing (not shown in the drawing) identifying the relevant club to use with the associated hole 40. Thus, for example, the left hand label may read 1, 2 3 & 5 woods and the centre and right hand labels refer to appropriate numbers and long irons and short irons respectively.

Extending vertically as shown in the drawing are three inset white strips 44 aligned with each of the holes. Again, each consists of a plastics strip inset into the "grass" and adhered or welded to the base material of the simulated turf mat.

Along the opposite side edges of the mat are inset two strips 46, 48 bearing respectively letters and numbers as shown.

It can thus be seen that all of the markings on the mat so far described are recessed from the upper "grassy" surface of the mat.

This makes for a particularly elegant construction since the upper surface of simulated plastics grass mats consists essentially of the ends of a set of upstanding strips or bristles. Such a surface presents a high friction surface both for someone standing on the mat and also for anything placed on the mat. Thus, in this embodiment, it is found to be entirely sufficient if the stance line is defined by a bar 50 which is simply laid on the top of the mat. Preferably the bar 50 has a cross section consisting of a lightly arched base with an upstanding rib on it. The edges of the base tend to dig in very slightly to the surface of the simulated turf and render the bar resistant to movement once it has been placed in position by the user. The placement is, as explained above, effected in accordance with the advice of the teacher having regard to the particular club proposed to be used by the golfer and, of course, having regard to the golfer's height and build. As illustrated in FIG. 4, the position of bar 50 may simply be designated as "C5".

As shown at the top of FIG. 4, and as illustrated by itself in the perspective drawing of FIG. 5, the mat cooperates with an indicator to assist the user perfecting his swing.

The indicator consists of a base member 60 having an aperture 62 and a short mounting rail 63 for receipt of the swing indicator strip described below. The base member 60 may be hinged at 61 to enable it to be folded to a convenient size for being kept inside the rolled up mat, but is preferably of the extent shown so that it sits underneath the mat and is firmly held in position. In use, aperture 62 is registered with one of the apertures 40 and movement is prevented in a translational direction parallel to strip 4 by the tee which is inserted through aperture 62 and then aperture 40 when the mat is first set up. Aperture 62 is elongate so enabling the swing guide member to be positioned with mounting rail 63 adjacent the top edge of mat 2 as shown in FIG. 4 or slightly spaced therefrom. When it is slightly spaced therefrom, there is also a certain small rotational freedom of movement about the axis of the tee which passes through aperture 62.

Mounted in the mounting rail 63 is a guide blade 64 which consists of a strip of tough preferably transparent plastics material, most conveniently a tough polycarbonate material such as those sold under the trade mark LEXAN. As can be seen, this has a straight section bearing a rail 65 which is a press fit with rail 63 and an arcuate section which extends, when rail 65 is set into rail 63, over base 60. The arcuate portion of the blade 66 extends above the surface of mat 2 and curves across the edge of the mat and then across strip 4. The arcuate portion 66 is preformed to a shape corresponding to the desired path of the head of the club as it approaches a ball seated on a tee set in one of the apertures 40.

In use, the swing guide provides an easily detectable indication of whether the user of the mat has, on any particular occasion, swung the club to pass substantially along the desired path (in which case the club will not touch any part of the upstanding blade 64, or whether the swing was rotated, relative to a notional vertical axis passing through the user, slightly clockwise as seen in FIG. 4 (in which case the end of the blade 64 adjacent the rail 65 will be impacted by the club head) or slightly anti-clockwise (in which case the arcuate blade 66 will be struck. This provides an easy visual indication of the correctness or otherwise of the user's swing.

It will be appreciated that the swing guide shown in FIG. 5 is particularly well adapted for use with the mat shown in FIG. 4, but that it can, in practice, be used without it, e.g. simply locating a tee through aperture 62 and fixing the base relative to the ground or floor in some appropriate fashion.

It will thus been seen that the present invention provides a mat by means of which golfers may be enabled to place their feet relative to a ball in a position projected mentally from the mat of this invention and known to be appropriate to the club to be used to hit the ball.

What is claimed is:

1. Apparatus for teaching or correcting a stance of a golfer when addressing a golf ball including a mat having a size sufficient to accommodate both feet of a golfer when adopting an addressing stance and including means defining at least one stance line against which a golfer's feet are placed when addressing a golf ball, the improvement comprising a ball line on the mat which is aligned with an intended line of flight of a golf ball, and indicia positioned on the mat in relation to the ball line indicating positions on the ball line at which a golf ball should be placed when the golf ball is struck with a golf club of a specified weight or number, wherein the ball line is spaced from the at least one stance line and the ball line is positioned at an acute angle to the at least one stance line.

2. Apparatus as claimed in claim 1 wherein the mat is made in two parts which are adjustably secured together, in which one part bears the ball line and in which one part has at least one stance line defined thereon.

3. Apparatus as claimed in either claim 1 or 2 wherein three stance lines are defined on the mat and each of said three stance lines are spaced a different distance from the ball line and at a different angle to the ball line.

4. Apparatus as claimed in claim 1 wherein the at least one stance line is detachably secured to one surface of the mat and repositionable on the mat to extend between different predetermined points on the mat.

5. Apparatus as claimed in claim 1 wherein the positions for a golf ball on the ball line which are to be used when a golfer is using a wood are differentiated visually from the positions for a golf ball on the ball line which are to be used when a golfer is using irons.

6. Apparatus as claimed in claim 5 wherein the positions for a golf ball associated with lower-numbered irons are further differentiated visually from the positions for a golf ball associated with higher-numbered irons.

7. Apparatus as claimed in claim 3 wherein each stance line has visual indications associated with said stance line which correspond to the indicia associated with the positions for a golf ball.

8. Apparatus as claimed in claim 1 wherein the ball line extends across a shorter width of the mat, said mat having a base of resilient material, and the ball line is visually distinguishable from other portions of the mat and from the at least one stance line.

9. Apparatus as claimed in claim 4 wherein each stance line is formed by a strip of material having a backing layer which is releasably fastened to a surface of the mat by the application of force to an exposed surface of the strip of material.

10. Apparatus as claimed in claim 1 wherein the ball line is traversed by a plurality of spaced sight lines positioned perpendicular to the ball line, the sight lines being visually distinguishable from the ball line to act as orientation guides for heads of golf clubs.

11. Apparatus as claimed in claim 4 wherein the mat includes within the mat a longitudinal series of sockets associated with each of the at least one stance line, and each of the at least one stance line is formed by a stance strip wherein each stance strip has projecting from one end of said stance strip a stud structured to fit in any socket of the series of sockets to act as a pivot for the stance strip.

12. Apparatus as claimed in claim 1 wherein the at least one stance line is a strip of material releasably fastened to the mat, and each region of the mat on which a stance line is adjustably positioned has attached to said region releasable fastening material engagable by one end of said strip of material, the releasable fastening material extending substantially perpendicular to the ball line.

13. Apparatus as claimed in claim 12 wherein each region has a pair of parallel strips of releasable fastening material secured to said region so that each strip of material forming said at least one stance line can be secured at any location along the length of the pair of parallel strips of releasable fastening material so as to extend therebetween at any chosen angle relative to the ball line.

14. Golf swing guide apparatus for use in combination with the apparatus of claim 1, said golf swing guide apparatus comprising a base member and a flexible upstanding guide, the guide being positionable such that the guide lies above an upper surface of the mat and includes a substantially planar portion which is positioned adjacent the ball line and substantially in position with a golf ball on a tee on the ball line, and an arcuate portion which extends across the ball line such that said arcuate portion's free end is present between a golfer and the ball line.

* * * * *